US007168271B2

(12) United States Patent
Yui

(10) Patent No.: US 7,168,271 B2
(45) Date of Patent: Jan. 30, 2007

(54) METHOD OF KNITTING KNIT-WEAR HAVING FRONT NECK AND KNIT-WEAR HAVING FRONT NECK

(75) Inventor: Manabu Yui, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 76 days.

(21) Appl. No.: 10/516,024

(22) PCT Filed: May 14, 2003

(86) PCT No.: PCT/JP03/06037

§ 371 (c)(1),
(2), (4) Date: Nov. 29, 2004

(87) PCT Pub. No.: WO03/102284

PCT Pub. Date: Dec. 11, 2003

(65) Prior Publication Data

US 2005/0183465 A1 Aug. 25, 2005

(30) Foreign Application Priority Data

May 31, 2002 (JP) ..... 2002-158778

(51) Int. Cl.
*D04B 7/30* (2006.01)

(52) U.S. Cl. ..... 66/64; 66/176

(58) Field of Classification Search ..... 66/64, 66/69, 70, 76, 175, 176

See application file for complete search history.

(56) References Cited

U.S. PATENT DOCUMENTS

| | | | | |
|---|---|---|---|---|
| 5,584,197 | A | 12/1996 | Okuno | |
| 5,943,884 | A * | 8/1999 | Kobata et al. | 66/176 |
| 6,085,553 | A * | 7/2000 | Schmidt et al. | 66/69 |
| 6,138,482 | A * | 10/2000 | Shima et al. | 66/69 |
| 6,668,593 | B2 * | 12/2003 | Okamoto | 66/64 |
| 6,766,667 | B2 * | 7/2004 | Dohtsu et al. | 66/69 |
| 6,935,140 | B2 * | 8/2005 | Okamoto | 66/69 |

FOREIGN PATENT DOCUMENTS

| | | |
|---|---|---|
| JP | 29-1329 | 3/1954 |
| JP | 3-75656 | 12/1991 |
| WO | 01/55491 | 8/2001 |
| WO | 02/070800 | 9/2002 |
| WO | 02/092895 | 11/2002 |

* cited by examiner

*Primary Examiner*—Danny Worrell
(74) *Attorney, Agent, or Firm*—Wenderoth, Lind & Ponack, L.L.P.

(57) ABSTRACT

Knitted loops of a neckline of a right breast portion or a left breast portion knitted by dividing a breast are transferred to a needle bed where a back is retained, and a front collar knitting portion is knitted on a neckline of the other breast portion. The front collar knitting portion is cast off from knitted loops at a center portion edge of a torso to a position where knitted loops of at least one neckline do not overlap with at least knitted loops of the other neckline. The knitted loops of the front collar knitting portion are transferred to a needle bed wherein knitted loops of the back are retained, the knitted loops of the one neckline are returned to an original needle bed, and a front collar knitting portion is knit on the one neckline. A predetermined number of stitches are cast off from knitted loops of a center portion edge of a breast of the front collar knitting portion. Armhole side edge portions of the left and right front collar knitting portions are made to face edges of the back, knitted loops of the front collar knitting portion and the back are continuously knit so as to knit a back collar knitting portion to the back, and then all knitted loops are cast off.

11 Claims, 5 Drawing Sheets

METHOD OF KNITTING KNIT-WEAR HAVING FRONT NECK AND KNIT-WEAR HAVING FRONT NECK

TECHNICAL FIELD

The present invention relates to a knitting method for knitwear having a front collar, and knitwear having a front collar. In particular, the present invention relates to knitwear having a front collar with a heretofore unknown shape, and a knitting method thereof.

BACKGROUND ART

In general, in a case of forming knitwear having a front collar which is folded back in a pronouncedly wide manner against a breast, such as an Italian collar, which opens wide outwardly, the front collar is formed separately from a torso, and a front collar portion is assembled to a neckline of a torso portion by sewing.

Particularly, with front collars which are so large that tips of right and left front collar portions overlap when raised, consecutively knitting these large right and left front collar portions and a back collar to a torso using a flat knitting frame is extremely difficult, so generally assembly to the torso is not performed by knitting.

This necessitates a step of sewing following knitting, which increases a number of steps necessitated to complete the knitwear.

Also, there has never been knitwear with a heretofore unknown shape, such as a design wherein a part of a front collar is used to form a shoulder portion of a breast, and wherein forming a shoulder line of the front collar is then folded back, which does not require an extra process of assembling a formed collar and front collar assembly to a neckline of an article regarding which knitting on a knitting machine has been completed.

SUMMARY OF THE INVENTION

The present invention has been developed in light of the above-described present state, and accordingly, it is an object of the present invention to provide a knitting method whereby knitwear having a large front collar can be knit without sewing, and to provide seamless knitwear which is highly fashionable and which has a front collar shape which has heretofore been unknown.

In order to enable knitting of knitwear having large front collars without performing sewing, the present invention is a knitting method for knitwear, using a flat knitting frame having at least a pair of front and back needle beds extending in a left and right direction and facing each other in a front and back direction, with at least one of the front and back needle beds being capable of sideways racking, and capable of loop transfer of knitted loops between the front and back needle beds, wherein a front collar is formed in which a left front collar portion and a right front collar portion are formed on a neckline of a breast, with a form such that each of these front collar portions pass a center of the breast and overlap a side of the other front collar portion, with the method including following steps for knitting after starting formation of the neckline:

1) a first step for knitting including dividing the breast into a right breast portion and left breast portion from the front neckline formation portion, and forming front neckline portions of the right breast portion and left breast portion by turning course;

2) a second step wherein knitted loops of either a left or right front neckline bordering at a center of the breast are moved to empty needles which do not obstruct knitting of a front collar portion being formed at the other front neckline, following which at the other front neckline a predetermined course is knit such that a front collar knitting portion is formed so as to form a front collar portion which passes the center of the breast to overlap the front collar portion of the other side respectively, and knitted loops positioned at a region of knitting needles to be used for knitting the latter front collar knitting portion are cast off; and 3) a third step wherein, following returning the knitted loops, that have been transferred to empty needles which do not obstruct the knitting, to original needles in the second step, the remaining one front collar knitting portion is formed so as to form a front collar portion which passes the center of the breast from the neckline to overlap the front collar portion of the other side.

According to the present invention as described above, at the time of knitting one front collar knitting portion, the other front collar knitting portion is moved to needles which do not interfere with knitting of the one front collar knitting portion, the one front collar knitting portion is knit, and knitted loops positioned within the range of knitting needles used for knitting the other front collar knitting portion at a last course of the knitted front collar knitting portion are cast off, whereby the other front collar knitting portion can be knit without interruption, so there is no need for a process for assembling the collar to the neckline of the torso by sewing, and the knitwear can be completed by knitting alone, and accordingly, a number of processes until completion of the knitwear is not great, and reduction in manufacturing costs can be realized.

Also, the present invention is an invention of a knitting method, enabling knitting knitwear having a large front collar of a heretofore unknown design to be knitted without sewing, and in the knitting method for knitwear having a front collar according to a first aspect, a breast and back making up the knitwear are knit in a seamless continuous cylindrical form, and the method includes the following steps:

1) a first step for knitting including dividing the breast into a right breast portion and left breast portion from a front neckline formation portion, and forming a front neckline portion of the right breast portion and a front neckline portion of the left breast portion to an edge of a shoulder neckline, and also knitting the back;

2) a second step for moving knitted loops of one or the other of the front neckline of the right breast portion and left breast portion knit in the first step to empty needles which do not obstruct knitting of the front collar knitting portion to be formed on the other neckline, knitting a front color knitting portion on the other neckline so as to form a front collar portion of a form passing a center of the breast and overlapping the other front color portion, moving the front collar knitting portion to the front collar knitting portion on the other side each time a predetermined course is knit of the front collar knitting portion, and repeating knitting for forming new knitted loops on empty needles on a neckline side by this moving so as to form a shoulder line portion to an armhole, and following completion of formation of the shoulder line portion to the front collar knitting portion, casting off knitted loops within a region of the knitting needles used for knitting at least the remaining other front collar knitting portion at the front collar knitting portion;

3) a third step wherein, following returning the knitted loops that have been transferred to empty needles which do not obstruct the knitting in the second step to the original needles, the other one front collar knitting portion is formed so as to form a front collar portion which passes the center of the breast from the remaining front neckline to overlap the front collar portion of the other side, moving the front collar knitting portion to the front collar knitting portion on the other side each time a predetermined course is knit of the front collar knitting portion, and repeating knitting for forming new knitted loops on empty needles on the neckline side by this moving so as to form a shoulder line portion to the armhole, and following completion of formation of the shoulder line portion to the front collar knitting portion, casting off knitted loops of an equal number to those cast off in the second step from a breast center side;

4) a fourth step for turning course such that a number of knitting courses becomes smaller each wale closer to each edge of the back, thereby forming a shoulder line portion on the back, following which a shoulder line portion of the left and right front collar knitting portions are assembled to the shoulder line portion of the back;

5) a fifth step for feeding yarn to the back and the front collar knitting portion not cast off, thereby knitting a collar wherein the left and right front collar knitting portions and the back color knitting portion are continuous; and 6) a sixth step for casting off knitted loops of the left and right front collar knitting portions and the back collar knitting portion retained by the needle beds.

According to the present invention as described above, knitwear having a new design of a large front collar opening wide, which is highly fashionable, can be knit while forming a shoulder portion of the torso with a part of the front collar knitting portion so as to have a shoulder line portion, even with a case of seamlessly cylindrically knitting the breast and torso.

Moreover, at the time of knitting one front collar knitting portion, the other front collar knitting portion is moved to needles which do not interfere with knitting of the one front collar knitting portion, the one front collar knitting portion is knit, and knitting loops positioned in a region of knitting needles used for knitting the other front collar knitting portion at a last course of this knitted front collar knitting portion are cast off, whereby the other front collar knitting portion can be knit without interruption.

Consequently, there is no need for a process for assembling the collar to the neckline of the torso by sewing, and the collar can be seamlessly assembled to the torso even in a case of designs of large folded open front collars and a back collar continuing therefrom, and accordingly, a number of processes until completion of the knitwear is not great, and reduction in manufacturing costs can be realized.

Also, the present invention is an invention of a knitting method for knitting knitwear having a large front collar and back collar without sewing, with knitwear of which a breast and back is seamlessly cylindrically knit, and in the knitting method for knitwear having a front collar according to the first aspect, the breast and back making up the knitwear are knit in a seamless continuous cylindrical form, and the method includes the following steps:

1) a first step for knitting including dividing the breast into a right breast portion and left breast portion from a front neckline formation portion, and forming front neckline portions of the right breast portion and left breast portion by turning course, and forming shoulder line portions on the left and right breast portions and the back by turning course, and assembling the shoulder line portions of the breast and back;

2) a second step for moving knitted loops of one or the other of a neckline of the right breast portion and left breast portion knit in the first step, to empty needles which do not obstruct knitting of the front collar knitting portion to the other neckline, following which the front collar portion is knit in a predetermined course to the other neckline so as to form a front collar portion which passes the center of the breast to overlap the front collar portion of the other side, and knitted loops positioned at a region of knitting needles to be used for knitting at least the remaining front collar knitting portion are cast off;

3) a third step wherein, following returning the knitted loops that have been transferred to empty needles which do not obstruct the knitting in the second step to original needles, and knitting a predetermined course for the other one front collar knitting portion so as to form a front collar portion which passes the center of the breast from the remaining front neckline to overlap the front collar portion of the other side, knitted loops of an equal number to those cast off in the second step are cast off from a breast center side;

4) a fourth step for subjecting the back and the front collar knitting portion not cast off to C-knitting wherein a yarn feeding direction is reversed at both edges thereof so as to knit a collar wherein left and right front color knitting portions and the back collar knitting portion are continuous; and 5) a fifth step for casting off knitted loops of the left and right front collar knitting portions and the back collar knitting portion retained by the needle beds.

According to the present invention as described above, in a case wherein the breast and back are seamlessly cylindrically knit and at the time of knitting one front collar knitting portion, the other front collar knitting portion is moved to needles which do not interfere with knitting of the one front collar knitting portion, the one front collar knitting portion is knit, and knitting loops positioned in a region of knitting needles used for knitting the other front collar knitting portion at a last course of this knitted front collar knitting portion are cast off, whereby the other front collar knitting portion can be knit without interruption. Consequently, there is no need for a process for assembling the collar to the neckline of the torso by sewing, and the collar can be seamlessly assembled to the torso and the knitwear can be completed by knitting alone, so a number of processes until completion of the knitwear is not great, and reduction in manufacturing costs can be realized.

Also, the present invention is an invention of knitwear having a front collar heretofore unknown, wherein a breast and back are seamlessly cylindrically knit, and wherein the breast is configured of a breast knitting portion having a front neckline and a part of a front collar knitting portion assembled to the front neckline, and wherein the front collar knitting portion has a shoulder line portion where a breast shoulder portion and back are assembled and a front collar portion opened by folding back, and wherein a back collar knitting portion formed to a back neckline of the back and the front collar knitting portion are knitted continuously, and wherein the front collar knitting portion is formed of a left front collar portion and right front collar portion to the neckline of the breast, with the front collar knitting portion and back collar knitting portion being seamlessly assembled to the torso, and wherein the front collar portions are of a shape so as to pass the center of the breast to overlap one another.

According to the present invention as described above, knitwear with a heretofore unknown new design having a large folded open front collar, and which is highly fashionable, can be provided with a shoulder portion of a breast being formed of a portion of a front collar knitting portion so as to have a shoulder line portion.

DETAILED DESCRIPTION OF THE PREFERRED EMBODIMENTS

Following is a description of embodiments of knitwear having a front collar, and a knitting method thereof, according to the present invention.

With the present embodiment, knitwear is knitted using a flat knitting frame having at least a pair of front and back needle beds extending in a left and right direction and facing each other in a front and back direction, with at least one of the front and back needle beds being capable of sideways racking, and capable of loop transfer of knitted loops between the front and back needle beds, i.e., a so-called two-bed flat knitting frame.

In an event of knitting cylindrical knitwear, a two-bed flat knitting frame is arranged so as to knit using every other needle on each of the front and back knitting beds, with odd-numbered needles of the front knitting bed being primarily used for knitting front side portions of knitwear, such as a breast and front portion of a collar or the like, and even-numbered needles of the back knitting bed being primarily used for knitting back side portions of knitwear, such as a back and rear portion of the collar or the like.

Further, the front and back needle beds have, as empty needles, needles in one bed facing needles in the other bed which are used for knitting, and the empty needles are used for loop transfer and ribbing and the like.

Using these empty needles enables constitution patterns wherein face stitches and rear stitches are combined such as links, garter, ribbing, and so forth, or moving knit portions of sleeves and a torso in a course direction so as to be assembled one to another.

Also, in an event of using a two-bed flat knitting frame, an arrangement may be made wherein a transfer jack bed, wherein transfer jacks are arrayed, may be provided above one of both of the front and back needle beds to knit a knitted fabric.

Also, while the present invention involves knitting knitwear using a two-bed flat knitting frame, the present invention may use a four-bed flat knitting frame made up of an upper front needle bed, lower front needle bed, upper back needle bed, and lower back needle bed.

In a case of using a four-bed flat knitting frame, for example, a back side portion is made to belong to the lower back needle bed, the upper back needle bed is used for loop transfer and the like of a knitted fabric at a front side portion, as empty needles for knitting a front side portion knitted fabric, and the upper front needle bed is used for loop transfer and the like of knitted fabric at the back side portion, as empty needles for knitting a back side portion knitted fabric.

The present invention illustrates a method for seamlessly knitting knitwear using the above-described two-bed flat knitting frame so that a torso and collar making up the knitwear are of a seamlessly continuous cylindrical shape, and also illustrates knitwear having a front collar knit from this knitting method.

Figure 1:
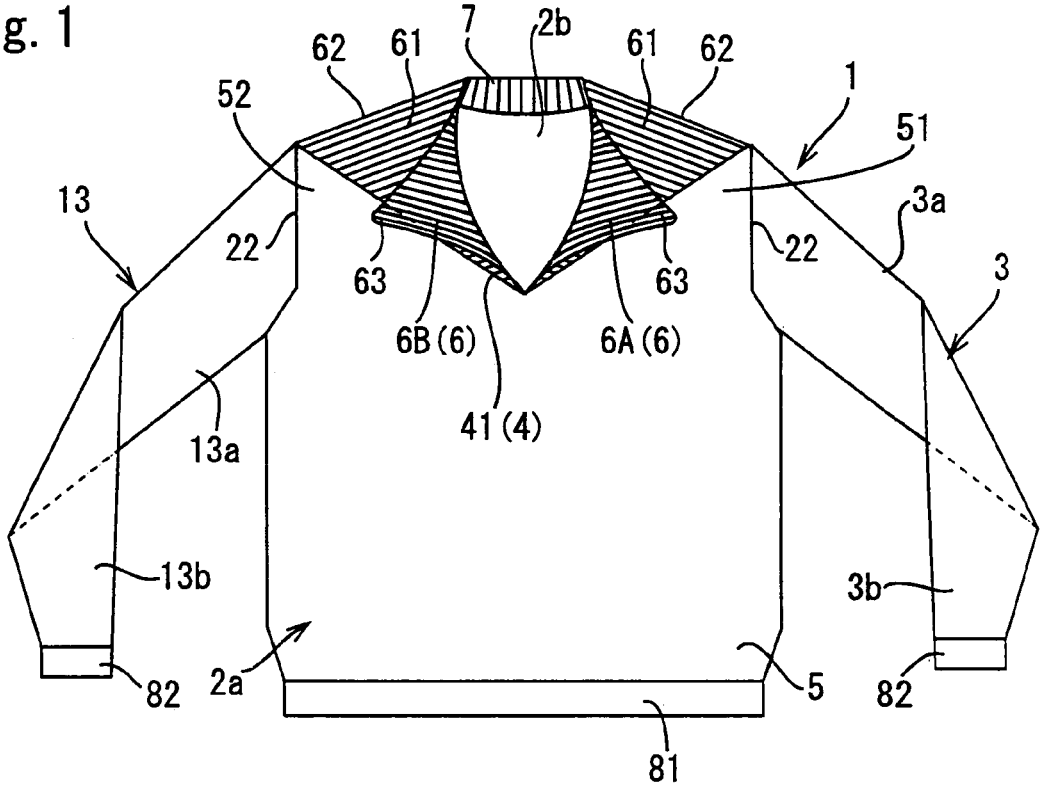
FIG. 1 is a frontal view from a breast side of a sweater having a front collar, which is a first embodiment of knitwear according to the present invention.
Figure 2:
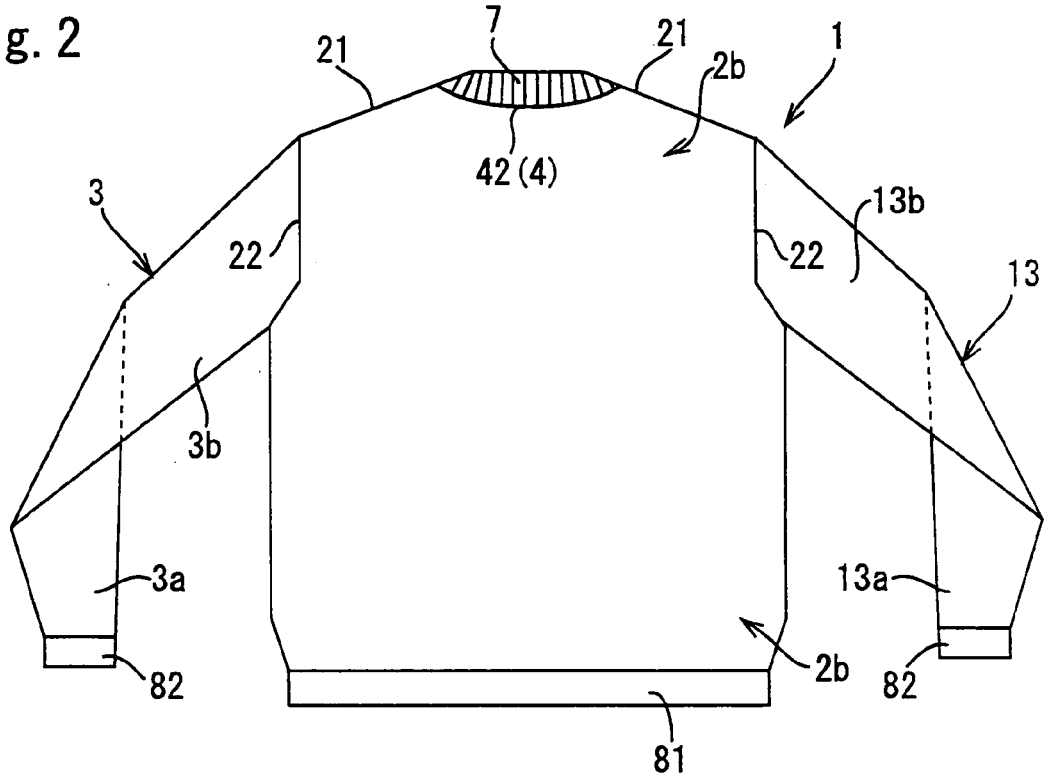
FIG. 2 is a rear view from a back side of a sweater having a front collar, which is the first embodiment of the knitwear according to the present invention.
Figure 3:
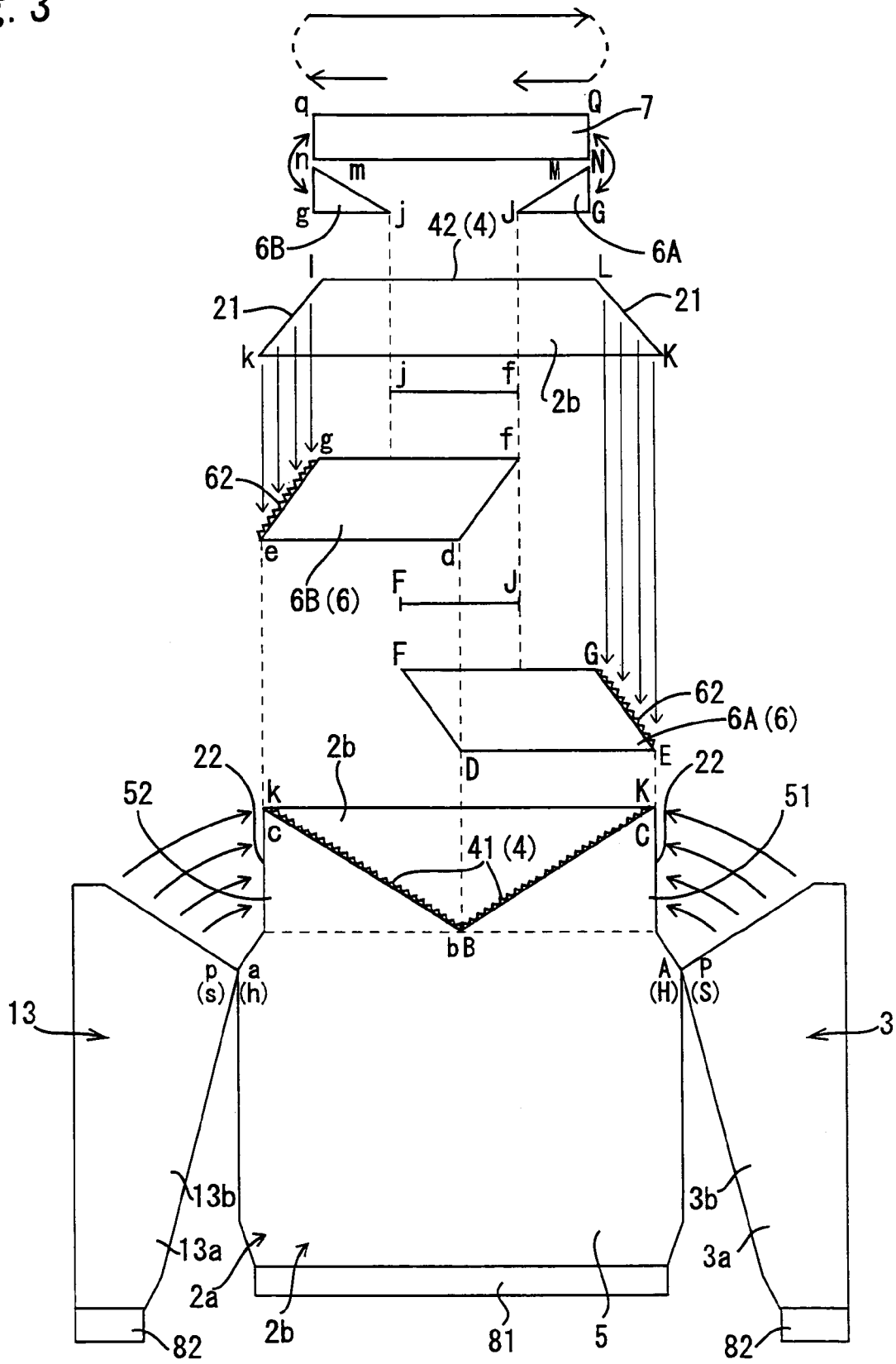
FIG. 3 is a knitting process diagram illustrating knitting procedures for knitting the knitwear according to the first embodiment.

A first embodiment of the present invention will be described based on FIG. 1 through FIG. 3. FIG. 1 is a frontal view from a breast side of a sweater 1 of knitwear having a front collar, which is a first embodiment of the knitwear according to the present invention. FIG. 2 is a rear view from a back side of the sweater 1 shown in FIG. 1. FIG. 3 is a knitting process diagram illustrating knitting procedures for knitting the sweater 1.

With the present embodiment, back 2*b*, right sleeve rear portion 13*b*, and left sleeve rear portion 3*b* are knit using primarily odd-numbered needles of a back needle bed, and breast 2*a*, right sleeve front portion 13*a*, and left sleeve front portion 3*a* are knit using primarily even-numbered needles of a front needle bed.

The sweater 1 knit with the present embodiment is a long-sleeve type sweater having a collar with large folded open front collar portions. As indicated in a knitting procedure diagram shown in FIG. 3, the sweater 1 according to the present embodiment is knit so that a height from a hem of the breast 2*a* to an assembly portion with a sleeve at a shoulder (number of courses) and a height from a hem of the back 2*b* to an assembly portion with the sleeve at the shoulder (number of courses) is the same.

Further, the breast 2*a* of the sweater 1 is configured of a breast knitting portion 5 having a neckline 4, and a part of a front collar knitting portion 6 assembled to the neckline 4.

The breast knitting portion 5 is knit from the hem to the shoulder, so that front neckline 41 ends at a shoulder connection portion of an armhole (an outer edge portion of the armhole at the shoulder).

The front collar knitting portion 6 is knitted having a breast shoulder portion 61, a shoulder line portion 62 to which the back 2*b* is assembled, and a front collar portion 63, with the front collar portion 63 forming part of a front collar which folds back and opens wide.

The shoulder line portion 62 of the front collar knitting portion 6 is assembled to shoulder line portion 21 of the back 2*b*, thereby forming a back collar knitting portion 7 knitted continuously from the front collar knitting portion 6 to the back 2*b*.

For sake of facilitating description, with the sweater 1, a knitting constitution of the breast knitting portion 5 of the breast 2*a*, the back 2*b*, and sleeves 3 and 13, will be understood to be plain knit, and the front collar knitting portion 6 and back collar knitting portion 7 ribbed, but the breast knitting portion 5, the back 2*b*, and the sleeves 3 and 13 may be of a constitution pattern such as jacquard or ribbed, and the front collar knitting portion 6 and back collar knitting portion 7 may be of another constitution pattern (the same is true for a second embodiment and third embodiment).

With the sweater 1, points A and a of the breast 2*a* to serve as an underarm portion are assembled to points P and p of the left sleeve front portion 3*a* and right sleeve front portion 13*a*, and points H and h of the back 2*b* are assembled to points S and s of the left sleeve rear portion 3*b* and right sleeve rear portion 13*b*.

The breast 2*a* and the left sleeve front portion 3*a* and right sleeve front portion 13*a* are then assembled along an armhole (sleeve line) 22, and the back 2*b* and the left sleeve rear portion 3*b* and right sleeve rear portion 13*b* are assembled.

The breast knitting portion 5 making up the breast 2*a* has a shape from points B and b on where the front neckline 41 is formed in a different shape as compared to that of the back 2*b*, and as shown in FIG. 3, is knit divided into left breast portion 51 and right breast portion 52.

Further, knitting of torso 2*a* and 2*b*, and sleeves 3 and 13 following starting of formation of the neckline 4 is performed by knitting in an order of the left breast portion 51, left sleeve front portion 3*a*, left sleeve rear portion 3*b*, back 2*b*, right sleeve rear portion 13*b*, right sleeve front portion 13*a*, and right breast portion 52, or in a reverse order, while the left sleeve front portion 3*a* is assembled to the left breast portion 51, the left sleeve rear portion 3*b* and right sleeve rear portion 13*b* are assembled to the back 2*b*, and the right sleeve front portion 13*a* is assembled to the right breast portion 52, along armholes 22.

Note that in the present embodiment, vocabulary representing left and right parts of the torso and the sleeves, such as the right and left sides for the right breast portion 52 and left breast portion 51 is based on a perspective of a wearer wearing the sweater 1.

Next, knitting procedures for the sweater 1 according to the first embodiment will be described based on the knitting procedure diagram shown in FIG. 3.

The knitting procedure diagram shown in FIG. 3 illustrates knitting procedures for sequentially knitting from a bottom toward a top in this figure.

First, following supplying of knitting yarn to each of breast knitting needles from yarn supply openings (not shown) provided for each of torso knitting and sleeve knitting, knitting wherein the yarn supply openings are reversed to supply knitting yarn to each of the back knitting needles is repeated, thereby forming a cylindrical torso hem portion and elastic knitting portions 81 and 82 at cuff portions.

Then, the breast 2*a* (breast knitting portion 5) and the back 2*b* are knit up to short of an underarm portion (points A, P, a, p, S, H, s, and h in FIG. 3), and at the same time, the left sleeve 3 and right sleeve 13 are knit while widening a cylinder diameter.

The torso 2 and left sleeve 3 and right sleeve 13 are assembled at the underarm portion so as to form a single cylindrical article, the breast knitting portion 5 is knit divided into the left breast portion 51 and right breast portion 52 by turning course, while also knitting the back 2*b* and left sleeve 3 and right sleeve 13, and at the same time as this knitting, the torso 2 and the left sleeve 3 and right sleeve 13 are assembled.

Upon the left breast portion 51 and right breast portion 52 of the breast knitting portion 5 being knitted to a position of points C and c, and the back 2*b* being knitted to a position of line K-k, assembly of the torso 2 and the left sleeve 3 and right sleeve 13 is completed.

Due to the knitting so far, formation of the front neckline 41 formed by turning course at the breast knitting portion 5 is completed, the breast knitting portion 5 and the back 2*b* are seamlessly cylindrically continuously knit, with assembly of the sleeves 3 and 13 to the torso 2 also being completed, with knitted loops of the front neckline 41 of the breast knitting portion 5 being retained at the front needle bed, and knitted loops of the back 2*b* being retained at the back needle bed.

Next, a left front collar knitting portion 6A is continuously knit (line D-E) on the front neckline 41 of the left breast portion 51 (line B-C).

At this time, the knitted loops of the neckline 41 on the right breast portion 52 (line b-c) are moved to empty needles so as to not obstruct knitting of the left front collar knitting portion 6A formed on another portion of the front neckline 41. With the present embodiment, the knitted loops of the neckline 41 on the right breast portion (line b-c) are transferred to empty needles of the front needle bed facing the even-numbered needles of the back needle bed retaining the knitted loops of the back.

Note that in an event of using a flat knitting frame having a holding device described in Patent Publication of Japanese Patent No. 2,995,464, the knitted loops of the front neckline 41 on the right breast portion 52 (line b-c) can be held by a slider of compound needles retaining the knitted loops of the back on the back needle bed.

Following knitting one course of the left front collar knitting portion 6A on the front neckline 41 of the left breast portion 51 (line B-C), the knitted loops of the left front collar knitting portion 6A are transferred to empty needles of the back needle bed, the back needle bed is racked two pitches in the left direction in FIG. 3 and the knitted loops of the left front collar knitting portion 6A are transferred to the front needle bed, and following knitting one course one yarn over to the right (sleeve side), the knitted loops of the left front collar knitting portion 6A are transferred to empty needles of the back needle bed, racked two pitches to the left, and the knitted loops of the left front collar knitting portion 6A are transferred to empty needles of the front needle bed, and this action is repeated until knitting the left front collar knitting portion 6A to line F-G.

The left front collar knitting portion 6A is cast off until line F-J, and knitted loops on line F-J are removed from the needles of the needle bed from a torso center side of the left front collar knitting portion 6A. The knitted loops on line F-J of the left front collar knitting portion 6A are cast off to a position where they do not overlap a final course of the right front collar knitting portion 6B, to prevent interference with knitting of the right front collar knitting portion 6B to be knit next.

Next, the right front collar knitting portion 6B is continuously knit (line d-e) on the front neckline 41 of the right breast portion 52 (line b-c).

The knitted loops of the front neckline 41 of the right breast portion 52 (line b-c) are moved to original odd-numbered needles of the front needle bed, and following knitting one course of the right front collar knitting portion 6B on the front neckline 41 of the right breast portion 52 (line b-c), the knitted loops of the right front collar knitting portion 6B are transferred to empty needles of the back needle bed, the back needle bed is racked two pitches to the right in FIG. 3 and the knitted loops of the right front collar knitting portion 6B are transferred to the front needle bed, and following knitting one course one yarn over to the left (sleeve side), the knitted loops of the right front collar knitting portion 6B are transferred to empty needles of the back needle bed, racked two pitches to the right, and the knitted loops of the right front collar knitting portion 6B are transferred to empty needles of the front needle bed, and this action is repeated until knitting the right front collar knitting portion 6B to line f-g.

The right front collar knitting portion 6B is cast off until line f-j, and the knitted loops on line f-j are removed from the needles of the needle bed from a torso center side of the right front collar knitting portion 6B. The same number of knitting loops on line f-j of the right front collar knitting portion 6B are cast off as the number of knitting loops cast off for the left front collar knitting portion 6A.

Yarn-over portions formed on sleeve-side edges of the left front collar knitting portion 6A and the right front collar knitting portion 6B thus form shoulder line portions 62 (line E-G, line e-g).

While the left front collar knitting portion 6A and the right front collar knitting portion 6B have been described as being knit in a predetermined number of courses with the same number of loops while performing yarn-over one at a time, knitted loops may be increased at a torso middle side in order to change a shape of the front collar.

Next, the back 2*b* is knit from a position of line K-k to a position of line L-l where formation of the shoulder line portion 21 is completed. The shoulder line portion 21 (line K-L, line k-l) is knit so that the shoulder drops off, by turning course. While knitting the back 2*b*, knitted loops of the shoulder line portion 62 of the left front collar knitting portion 6A and the right front collar knitting portion 6B are retained to the front needle bed and the knitted loops of the shoulder line portion 21 of the back 2*b* are joined.

Upon assembling of the shoulder line portion 62 and the shoulder line portion 21, knitted loops of back neckline 42 of the back 2*b* (line L-l) are retained to the back needle bed, and knitted loops of the left front collar knitting portion 6A (line G-J) and the right front collar knitting portion 6B (line g-j) are retained to the front needle bed.

Note that assembling of the shoulder line portion 62 and the shoulder line portion 21 may be performed following completing knitting of the back 2*b*.

Next, repeating in the order of the right front collar knitting portion 6B, back collar knitting portion 7, left front collar knitting portion 6A, back collar knitting portion 7, and right front collar knitting portion 6B, a knitting method is performed called C-knitting on these three components wherein a same path is traced while moving reciprocally, while changing a direction of progression of the yarn supply openings at both edges which are boundaries of each of the components.

Thus, continuous knitting is realized for the left front collar knitting portion 6A from a position of line G-J to point M, for the right front collar knitting portion 6B from a position of line g-j to point m, and for the back collar knitting portion 7 from a position of line N-n to a position of line Q-q.

At this time, the left front collar knitting portion 6A and right front collar knitting portion 6B are knit such that a number of knitting courses at the torso center side for each wale increases towards at least outer edges (line J-M, line j-m).

Note that while with the present embodiment, knitting is performed so that the number of knitting courses for the back collar knitting portion 7 is the same at all portions, or the back collar knitting portion 7 may be knit so that the number of knitting courses is smaller toward both edges, so as to take up turning course of the left front collar knitting portion 6A and right front collar knitting portion 6B.

After all courses of the left front collar knitting portion 6A, right front collar knitting portion 6B, and back collar knitting portion 7 have been completed, knitted loops of an upper edge of the left front collar knitting portion 6A, right front collar knitting portion 6B, and back collar knitting portion 7 (line J-M-Q-q-m-j) are continuously cast off, thereby completing knitting of the collar, and thus the sweater 1 having the front collar shown in FIG. 1 and FIG. 2 is completed.

As described above, with the knitwear according to the first embodiment, at a time of knitting the left front collar knitting portion 6A, the right front collar knitting portion 6B is moved to empty needles so as to not interfere with the knitting of the left front collar knitting portion 6A, whereby the left front collar knitting portion 6A is knit, and a final course of knit left front collar knitting portion 6A is cast off at a position so as to not overlap with a final course at a time of knitting the right front collar knitting portion 6B, whereby the right front collar knitting portion 6B can be knit without interruption.

Consequently, there is no need for a process for assembling a collar to the neckline of the torso by sewing even in a case of a large front collar, and the knitwear can be completed by knitting alone, so a number of processes until completion of the knitwear is not great, and reduction in manufacturing costs can be realized.

Moreover, with the design of the knitwear according to the first embodiment, a shoulder portion of the breast 2*a* is formed of a part of the front collar knitting portion 6 so as to have a shoulder line 62, whereby a new design with a large front collar folded back can be made, which is highly fashionable.

Moreover, regardless of a design having a large folded-back front collar 63 and a back collar connected thereto, these collars can be assembled to the torso without sewing.

Figure 4:
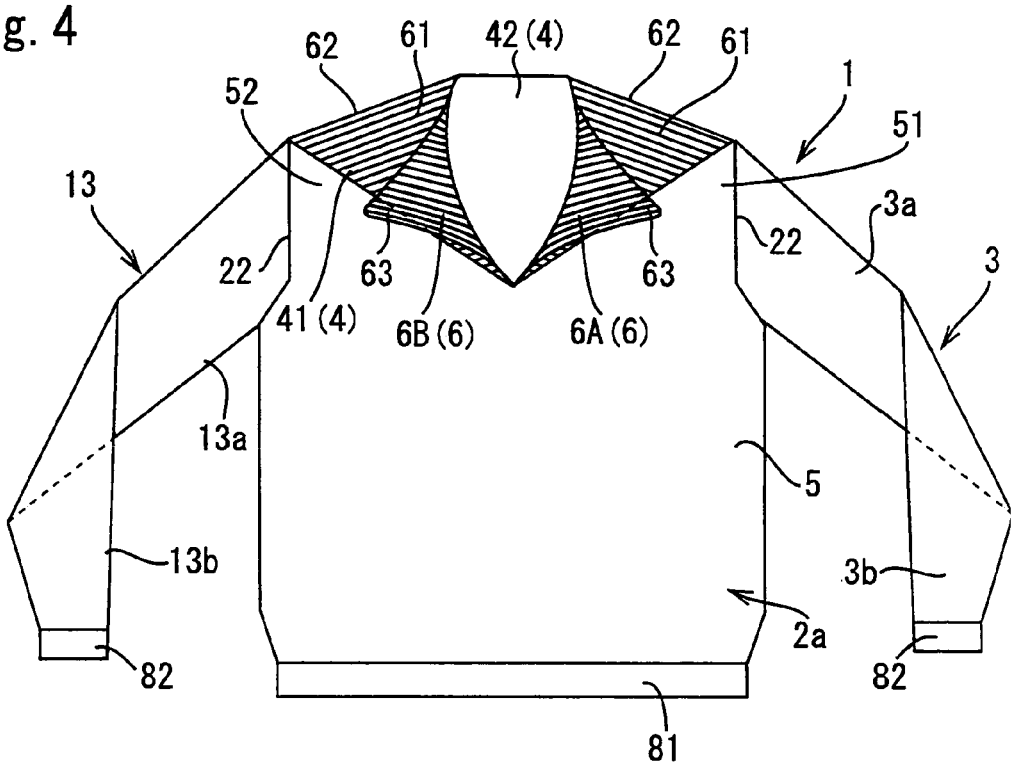
FIG. 4 is a frontal view from a breast side of a sweater having a front collar, which is a second embodiment of knitwear according to the present invention.
Figure 5:
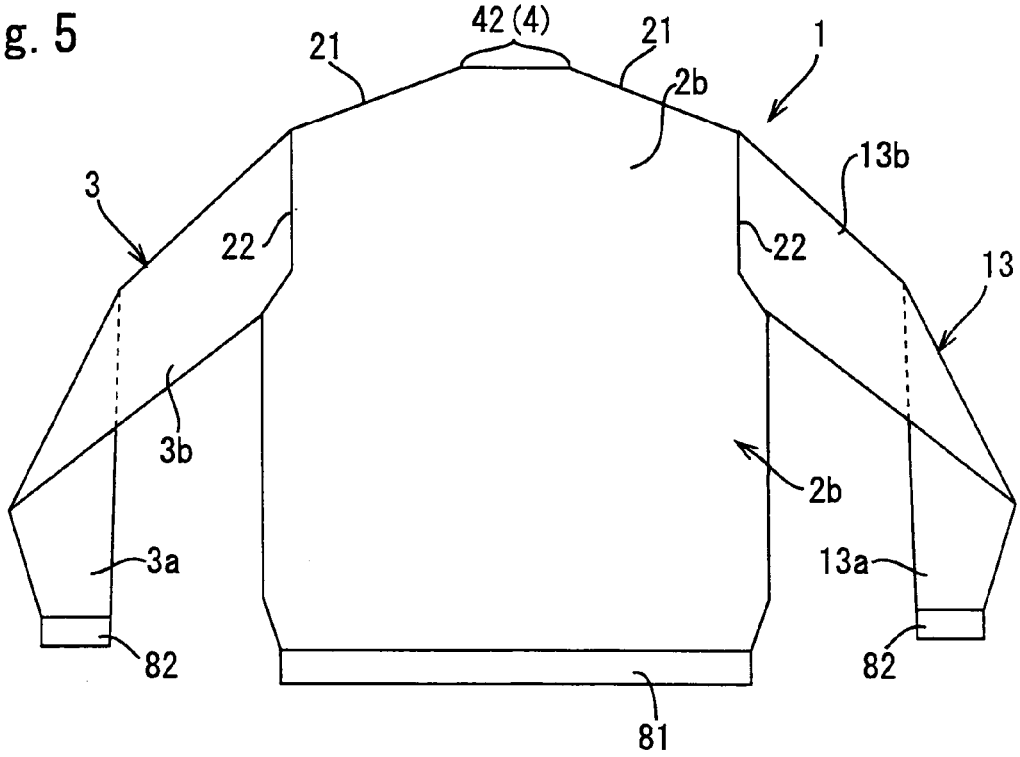
FIG. 5 is a rear view from a back side of a sweater having a front collar, which is the second embodiment of the knitwear according to the present invention.

Also, with the first embodiment described above, the back collar knitting portion 7 was formed on the back 2*b*, but an arrangement may be made wherein no back collar knitting portion is formed on the back 2*b*, as with a second embodiment shown in FIG. 4 and FIG. 5.

With the knitting method of the sweater 1 according to the second embodiment, in a knitting process of the first embodiment shown in FIG. 3 an alteration is made such that, following knitting to a position of line G-F of left front collar knitting portion 6A all are cast off up to line G-F except for shoulder line portion 62 of line E-G, and following knitting to a position of line g-f of right front collar knitting portion 6B all are cast off up to line g-f except for shoulder line portion 62 of line e-g, and shoulder line portion 62 and shoulder line portion 21 are assembled while knitting from a position of line K-k of back 2*b* to a position of line L-l, and knitted loops of line L-l of the back 2*b* are cast off, thereby completing knitting of the knitwear.

The knitwear according to the second embodiment has a collar formed only on breast 2*a*, a shoulder portion of the breast 2*a* is formed of a part of front collar knitting portion 6 so as to have a shoulder line 62, whereby a new design can be made even with a collar knitting portion 63 with a large front collar folded back, which is highly fashionable.

With types wherein the collar is formed only on the breast 2*a* as with the second embodiment, an arrangement made wherein breast knitting portion 5 of the breast and the front collar knitting portion 6 are knitted alone, and assembled with the back.

Figure 6:
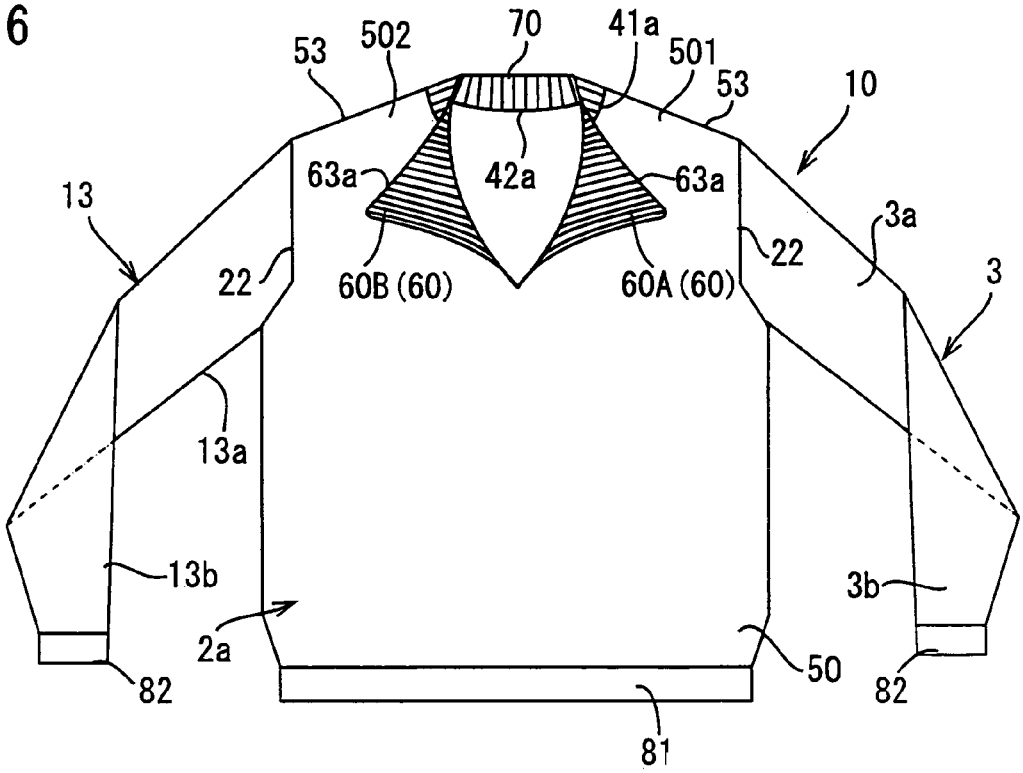
FIG. 6 is a frontal view from a breast side of a sweater having a front collar, which is a third embodiment of knitwear according to the present invention.
Figure 7:
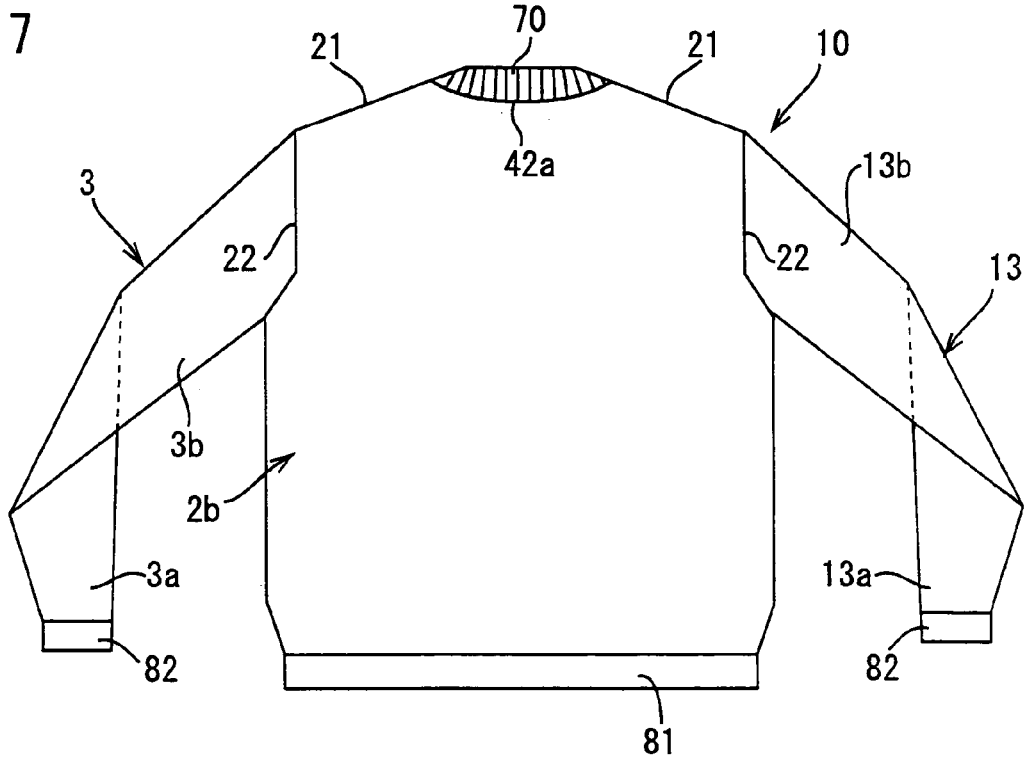
FIG. 7 is a rear view from a back side of a sweater having a front collar, which is the third embodiment of the knitwear according to the present invention.

Also, while description has been made with the first embodiment and second embodiment of an arrangement wherein shoulder portions of the breast 2*a* are formed of the front collar knitting portion 6, and shoulder line portions 62 are formed of the front collar knitting portion 6, an arrangement may be made as illustrated with a third embodiment shown in FIG. 6 and FIG. 7, wherein a shoulder portion and shoulder line portion 53 are formed with breast knitting portion 50 without forming the shoulder portion and shoulder line portion of the torso with front collar knitting portion 60.

Sweater 10 knit according to the third embodiment is also a long-sleeve type sweater with a large front collar which is folded back. As shown in a knitting procedure diagram of FIG. 8, the sweater 10 according to the present embodiment is knit so that a height from a hem of breast 2*a* to an assembly portion with a sleeve at a shoulder (number of courses), and a height from a hem of back 2*b* to an assembly portion with the sleeve at the shoulder (number of courses), is the same.

Further, the sweater 10 has the breast 2*a* formed only of a breast knitting portion 50 having a front neckline 41*a* and shoulder line portion 53, with the front neckline 41*a* formed in a V-shape.

The front collar knitting portion 60 has a front collar portion 63*a* assembled to the front neckline 41*a* of the breast knitting portion 50, thereby configuring a front collar folded up wide of the front collar portion 63*a*.

The shoulder line portion 53 of the breast knitting portion 50 and the shoulder line portion 21 of the back 2*b* are then assembled, thereby forming a back collar knitting portion 70 wherein the front collar knitting portion 60 is continuously knit to the back 2*b*.

The sweater 10 has points A and a of the breast 2*a* to serve as underarm portions and points P and p of left sleeve front portion 3*a* and right sleeve front portion 13*a* assembled, and points H, h of the back 2*b* with points S, s of left sleeve rear portion 3*b* and right sleeve rear portion 13*b*.

The breast 2*a* and the left sleeve front portion 3*a* and right sleeve front portion 13*a* are then assembled along armhole 22, and the back 2*b* and the left sleeve rear portion 3*b* and right sleeve rear portion 13*b* are assembled.

Figure 8:
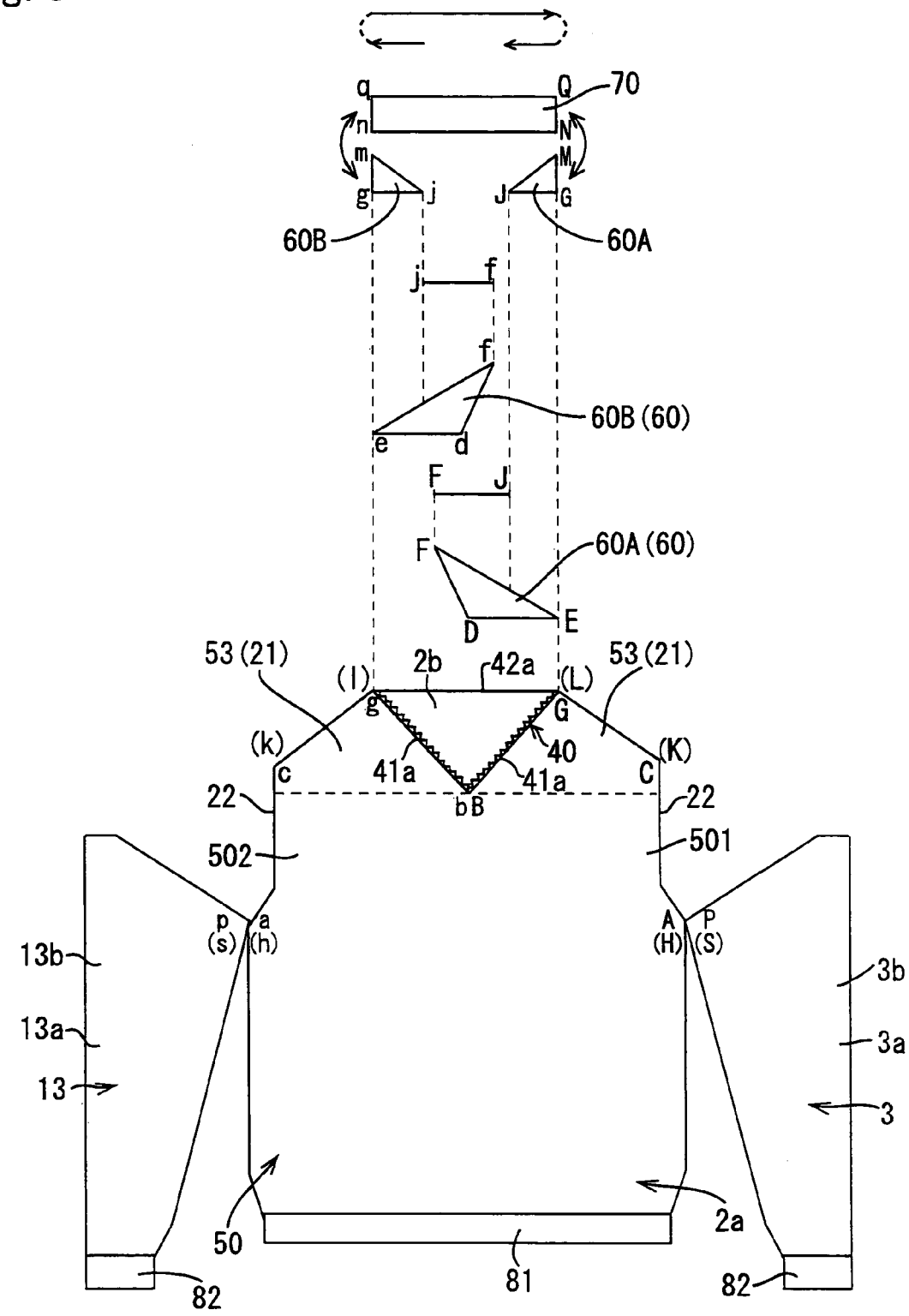
FIG. 8 is a knitting process diagram illustrating knitting procedures for knitting the knitwear according to the third embodiment.

The breast knitting portion 50 making up the breast 2*a* has a shape different from that of the back 2*b* from points B and b on from which formation of the front neckline 41*a* starts, and as shown in FIG. 8 is knitted divided into a left breast portion 501 and right breast portion 502.

Note that assembly of torso 2*a* and 2*b* and the left sleeve 3 and right sleeve 13 is the same knitting method as that in the first embodiment, so description thereof will be omitted.

Next, knitting procedures of the sweater 10 according to the third embodiment will be described with reference to FIG. 8. The knitting procedure diagram shown in FIG. 8 also illustrates knitting procedures for sequentially knitting from a bottom toward a top in this figure.

Knitting procedures up to an underarm portion (points A, P, a, p, S, H, s, and h in FIG. 2) are the same as those of the first embodiment with the sweater 10 according to the third embodiment as well, so description thereof will be omitted.

The torso 2 and left sleeve 3 and right sleeve 13 are assembled at the underarm portion so as to form a single cylindrical article, the breast knitting portion 50 is knit divided into the left breast portion 501 and right breast portion 502 by turning course, while also knitting the back 2*b* and left sleeve 3 and right sleeve 13.

Upon the left breast portion 501 and right breast portion 502 of the breast knitting portion 50 being knitted to a position of points C and c, and the back 2*b* being knitted to a position of line K-k, assembly of the torso 2 and the left sleeve 3 and right sleeve 13 is completed.

Then, knitting by turning course from a position of points C, c of the breast knitting portion 50 to a position of points G, g, and knitting by turning course from a position of the points K, k of the back 2*b* to a position of points L, l, shoulder line portion 53 is formed to the breast knitting portion 50, and the shoulder line portion 21 is formed on the back 2*b*. Further, the shoulder line portion 53 and shoulder line portion 21 are assembled while knitting the breast knitting portion 50 and the back 2*b*.

Due to the knitting so far, formation of neckline 40 to the breast knitting portion 50 and back 2*b* is completed, the breast knitting portion 50 and the back 2*b* are seamlessly cylindrically continuously knit, with assembly of the sleeves 3 and 13 to the torso 2 also being completed, with knitted loops of the front neckline 41*a* of the breast knitting portion 50 being retained at the front needle bed, and knitted loops of the back neckline 42*a* of the back 2*b* being retained at the back needle bed.

Next, a left front collar knitting portion 60A is continuously knit (line D-E) on the front neckline 41*a* of the left breast portion 501 (line B-G).

At this time, knitted loops of the front neckline 41*a* on the right breast portion 502 (line b-g) are moved to empty needles so as to not obstruct knitting of the left front collar knitting portion 60A formed on the other front neckline 41*a*. With the present embodiment, knitted loops of the front neckline 41*a* on the right breast portion 502 (line b-c) are transferred to empty needles of the front needle bed facing even-numbered needles of the back needle bed retaining knitted loops of the back.

Note that with the present embodiment as well, in an event of using the flat knitting frame having the holding device described in the Patent Publication of Japanese Patent No. 2,995,464, the knitted loops of the front neckline 41*a* on the right breast portion 502 (line b-c) can be held by the slider of compound needles retaining the knitted loops of the back on the back needle bed.

Then, the left front collar knitting portion 60A is knit onto the front neckline 41*a* of the left breast portion 501 (line B-G) while increasing stitches at a torso center side, and turning course so as to reduce a number of wales at a right side (shoulder side edge portion), up to point F.

Then the left front collar knitting portion 60A is cast off to line F-J, and knitted loops on line F-J are removed from needles of the needle bed from the center side of the torso of the left front collar knitting portion 60A.

The knitted loops of line F-J of the left front collar knitting portion 60A are cast off to a position so as to not overlap a predetermined course of the right front collar knitting portion 60B, to prevent interference with knitting of the right front collar knitting portion 60B to be knit next.

Next, the right front collar knitting portion 60B is continuously knit (line d-e) on the front neckline 41*a* of the right breast portion 502 (line b-g).

The right front collar knitting portion 60B is then consecutively knit (line d-e) to the front neckline 41*a* of the right breast portion 502 (line b-g) while turning course to reduce a number of wales of a left side (shoulder side edge portion) while increasing stitches at the torso center side, up to point f.

Then the right front collar knitting portion 60B is cast off to line f-j, and knitted loops on line f-j are removed from needles of the needle bed from the center side of the torso of the right front collar knitting portion 60B.

The same number of knitting loops on line f-j of the right front collar knitting portion 60B are cast off as the number of knitting loops cast off for the left front collar knitting portion 60A.

Then, knitted loops of back neckline 42*a* of the back 2*b* (line L-l) are retained to the back needle bed, and knitted loops of the left front collar knitting portion 60A (line G-J) and the right front collar knitting portion 60B (line g-j) are retained to the front needle bed.

Next, repeating in an order of the right front collar knitting portion 60B, back collar knitting portion 70, left front collar knitting portion 60A, back collar knitting portion 70, and the right front collar knitting portion 60B, a knitting method called C-knitting is performed on these three components wherein the same path is traced while moving reciprocally, while changing a direction of progression of the yarn supply openings at both edges which are boundaries of each of these components.

Thus, continuous knitting is realized for the left front collar knitting portion 60A from a position of line G-J to point M, for the right front collar knitting portion 60B from a position of line g-j to point m, and for the back collar knitting portion 70 from a position of line N-n to a position of line Q-q.

At this time, the left front collar knitting portion 60A and right front collar knitting portion 60B are knit such that a number of knitting courses at the torso center side for each wale increases towards at least outer edges (line J-M, line j-m).

Note that while with the present embodiment, knitting is performed so that a number of knitting courses for the back collar knitting portion 70 is the same at all portions, the back collar knitting portion 70 may be knit so that the number of knitting courses is smaller toward both edges, so as to take up a turning course of the left front collar knitting portion 60A and right front collar knitting portion 60B.

After a predetermined number of courses of the left front collar knitting portion 60A, right front collar knitting portion 60B, and back collar knitting portion 70 have been completed, knitted loops of an upper edge of the left front collar knitting portion 60A, right front collar knitting portion 60B, and back collar knitting portion 70 (line J-M-Q-q-m-j) are continuously cast off, thereby completing knitting, and thus the sweater 10 having the front collar shown in FIG. 6 and FIG. 7 is completed.

As described above, with the knitwear according to the third embodiment as well, there is no need for a process for assembling a collar to a neckline of a torso by sewing, and the knitwear can be completed by knitting alone, so a number of processes until completion of the knitwear is not great, and reduction in manufacturing costs can be realized.

Also, the knitting method according to the present invention is not restricted to a front collar shape shown in the embodiments, and any type can be dealt with as long as there is a front collar that is opened by folding back.

Further, the present invention is not restricted to sweaters, and can be applied to cardigans, and further can be applied to sweaters without sleeves, vests, and the like.

The invention claimed is:

1. A method for knitting knitwear by using a flat knitting frame having at least a front needle bed and a back needle bed, with the front and back needle beds extending in a left to right direction and facing each other in a front to back direction, and with at least one of the front and back needle beds being capable of sideways racking and capable of transfer of knitted loops between the front and back needle beds, wherein the knitwear has a breast and a collar including a left front collar portion on a neckline of the breast and a right front collar portion on the neckline of the breast, with the right and left front collar portions passing a center of the breast and overlapping one another when turned away from the breast, said method comprising, after starting formation of the neckline:

(i) forming a front neckline portion of a right breast portion and a front neckline portion of a left breast portion by knitting courses, with each of said courses being knit in a direction opposite to a direction in which a previous one of said courses was knit;

(ii) transferring knitted loops, of one of the front neckline portion of the right breast portion and the front neckline portion of the left breast portion, from needles to empty needles which do not obstruct knitting of one of the right front collar portion and the left front collar portion, thereafter, at the other one of the front neckline portion of the right breast portion and the front neckline portion of said left breast portion, knitting predetermined courses such that the one of the right front collar portion and the left front collar portion is formed so as to pass the center of the breast, and then, casting off knitted loops positioned at a region of knitting needles used for knitting the one of the right front collar portion and the left front collar portion; and then (iii) after returning to said needles said knitted loops that have been transferred therefrom to said empty needles, at the one of the front neckline portion of the right breast portion and the front neckline portion of the left breast portion, knitting predetermined courses such that the other one of the right front collar portion and the left front collar portion is formed so as to pass the center of the breast and overlap the one of the right front collar portion and the left front collar portion.

2. The method according to claim 1, further comprising:

knitting a first portion of the breast and a first portion of the back into a seamless continuous cylindrical form.

3. The method according to claim 2, wherein knitting predetermined courses such that the one of the right front collar portion and the left front collar portion is formed comprises knitting the predetermined courses such that the one of the right front collar portion and the left front collar portion terminates at a first shoulder line portion, and knitting predetermined courses such that the other one of the right front collar portion and the left front collar portion is formed comprises knitting the predetermined courses such that the other one of the right front collar portion and the left front collar portion terminates at a second shoulder line portion, said method further comprising:

knitting a second portion of the back to the first shoulder line portion and the second shoulder line portion.

4. The method according to claim 3, wherein knitting predetermined courses such that the one of the right front collar portion and the left front collar portion is formed comprises (i) knitting a part of the one of the right front collar portion and the left front collar portion, (ii) transferring knitted loops of the part of the one of the right front collar portion and the left front collar portion between empty needles of the front and back needle beds, (iii) knitting another part of the one of the right front collar portion and the left front collar portion, (iv) transferring knitted loops of the another part of the one of the right front collar portion and the left front collar portion between empty needles of the front and back needle beds, and (v) repeating (i)–(iv)

such that casting off knitted loops positioned at a region of knitting needles used for knitting the one of the right front collar portion and the left front collar portion comprises casting off knitted loops positioned at a region of knitting needles used for knitting a final part of the one of the right front collar portion and the left front collar portion, and knitting predetermined courses such that the other one of the right front collar portion and the left front collar portion is formed comprises (vi) knitting a part of the other one of the right front collar portion and the left front collar portion, (vii) transferring knitted loops of the part of the other one of the right front collar portion and the left front collar portion between empty needles of the front and back needle beds, (viii) knitting another part of the other one of the right front collar portion and the left front collar portion, (ix) transferring knitted loops of the another part of the other one of the right front collar portion and the left front collar portion between empty needles of the front and back needle beds, and (x) repeating (vi)–(ix), said method further comprising:

casting off knitted loops, equal in number to that of the knitted loops cast off at the region of knitting needles used for knitting the final part of the one of the right front collar portion and the left front collar portion, from a breast center side of the other one of the right front collar portion and the left front collar portion.

5. The method according to claim 4, wherein forming the front neckline portion of the right breast portion and the front neckline portion of the left breast portion, by knitting courses, with each of said courses being knit in a direction opposite to a direction in which a previous one of said courses was knit, results in a number of the courses becoming smaller for each wale closer to each edge of the back such that a shoulder line portion of the back is formed, and knitting a second portion of the back to the first shoulder line portion and the second shoulder line portion comprises knitting the shoulder line portion of the back to the first shoulder line portion and the second shoulder line portion.

6. The method according to claim 5, wherein the collar also has a back collar portion, said method further comprising:

feeding yarn to the back and a portion of the front collar not cast off, thereby knitting a back collar portion so as to be continuous with the left front collar portion and the right front collar portion.

7. The method according to claim 6, further comprising:

casting off knitted loops of the left and right front collar portions and the back collar portion retained by the needle beds.

8. The method according to claim 3, further comprising:

casting off knitted loops, equal in number to that of the knitted loops cast off at the region of knitting needles used for knitting the one of the right front collar portion and the left front collar portion, from a breast center side of the other one of the right front collar portion and the left front collar portion.

9. The method according to claim 8, wherein the collar also has a back collar portion, said method further comprising:

subjecting a back collar portion and the right front collar portion and the left front collar portion, not cast off, to C-knitting whereby a yarn feeding direction is reversed at both edges of the right and left front collar portions such that the right and left front collar portions and the back collar portion are continuous.

10. The method according to claim 9, further comprising:

casting off knitted loops of the right and left front collar portions and the back collar portion retained by the needle beds.

11. Knitwear comprising:

a breast having a front neckline and a back having a back neckline, with said breast and said back being seamlessly cylindrically knit; and a collar, said collar including a left front collar portion seamlessly knit to said front neckline, a right front collar portion seamlessly knit to said front neckline, and a back collar portion seamlessly knit to said back neckline, with said back collar portion and said right and left front collar portions being continuously knit, with said right and left front collar portions each have a shoulder line portion where a corresponding breast shoulder portion and said back are assembled, and with said right and left front collar portions passing a center of said breast and overlapping one another when turned away from said breast.

* * * * *